United States Patent [19]

Ruffolo

[11] Patent Number: 4,751,900

[45] Date of Patent: Jun. 21, 1988

[54] ADJUSTABLE SEGMENTED ROTARY TWIN PORT VALVE SHAFT

[76] Inventor: Russ F. Ruffolo, 5N302 Lloyd, Itasca, Ill. 60143

[21] Appl. No.: 19,507

[22] Filed: Feb. 26, 1987

[51] Int. Cl.[4] ..... F01L 7/10

[52] U.S. Cl. ..... 123/190 BB; 123/190 BD

[58] Field of Search ..... 123/190 R, 190 A, 190 B, 123/190 BB, 190 BA, 190 BD, 80 BA

[56] References Cited

U.S. PATENT DOCUMENTS

| | | | |
|---|---|---|---|
| 1,011,748 | 12/1911 | Coffin | 123/190 B |
| 1,125,101 | 1/1915 | Hughes | 123/190 BB |
| 1,172,093 | 2/1916 | Wilson et al. | 123/190 BB |
| 1,616,029 | 2/1927 | Dock | 123/190 BD |
| 1,765,556 | 6/1930 | Wilkinson | 123/190 BD |
| 3,730,161 | 5/1973 | Deane | 123/190 BD |
| 3,948,227 | 4/1976 | Guenther | 123/190 BD |
| 4,016,840 | 4/1977 | Lockshaw | 123/190 BD |
| 4,244,338 | 1/1981 | Rassey | 123/190 A |
| 4,333,427 | 6/1982 | Burillo et al. | 123/190 A |
| 4,381,737 | 5/1983 | Turner | 123/190 A |

*Primary Examiner*—Willis R. Wolfe
*Assistant Examiner*—M. Macy

[57] ABSTRACT

An adjustable rotating valve shaft system for the introduction and exhausting of gases of the internal combustion engine, comprising an adjustable rotating valve shaft driven by the crankshaft, consisting of smaller sections, one or more per cylinder, each section containing either or both intake and exhaust passages, each section being serrated or notched on both ends so as to inter-lock and be adjustable as per valve timing specifications. Intake and exhaust passage are separated by annular seal rings. The complete shaft assembly rotates in a lubricated one piece or two-halved machined bore, said bore having access to openings to combustion chambers of all cylinders, and all openings of the intake and exhaust manifolds. The exhaust passage has an extention protruding into but not fluidly exposed or open to the venturi shaped passage in the intake section of the rotating valve shaft and in doing so imparting intense heat to the incoming charge so as to atomize it effectively for greater volumetric efficiency. The rotating shaft rotates at one-fourth speed that of the crankshaft, thereby reducing wear and noise levels to a minimum, and providing full opening and closing of passages in shorter periods of time at proper sequence of valve timing, and eliminating all reciprocating parts which are found in conventional valve systems in use today.

3 Claims, 3 Drawing Sheets

ADJUSTABLE SEGMENTED ROTARY TWIN PORT VALVE SHAFT

BACKGROUND OF THE INVENTION

1. Field of the Invention

The invention described herewith improves the method of inducting and exhausting of gases consumed and produced by internal and external combustion engines which have normally aspirated and or supercharged or forced induction intake systems for the introduction of combustible gases into and out of the individual combustion chambers of the engine completely eliminating all reciprocating parts and their inherent characteristics of wear and sound production and resonance which is normally found in the valve systems of current or existing internal and external combustion engines utilizing any type of poppet or reed valve. The unique serrated or notched valve shaft sections also heats the combustible mixture to insure atomization as the charge enters the combustion chamber. Individual serrated or notched valve sections can be easily removed for repairs or replcement, and for altering of degrees or duration of valve timing pertaining to specific engine power requirements.

2. Background Art

In reference to H. Eschewells U.S. Pat. No. 1,286,967, my invention the ADJUSTABLE SEGMENTED ROTARY TWIN PORT VALVE SHAFT, eliminates the use of a separate rotary valve shaft for the functions of intake and exhaust cycles such as is apparent in U.S. Pat. No. 1,286,967, by combineing both intake and exhaust ports or passages on the same rotating shaft section similar to Calkins and Johnsons U.S. Pat. No. 1,079,741, but having the added features that the individual heat resistant rotating shaft sections are separated and serrated on both ends so as to align or inter-lock in a specific sequence of valve timing with the corresponding rotating shaft sections of the other cylinders, allowing the altering of valve timing dictated by power requirements of the individual engine, each length or section containing ports or passages drilled or machined diametrically through the shaft diameter, the exhaust passage having an extension or tube impervious to extreme heat, protruding into but not communicating with the adjoining intake passage within the rotating shaft section, the intake passage or port converging to and diverging from the center of the shaft diameter, forming a venturi, the heated extention atomizing the combustable mixture as it accelerates through the venturi enroute into the combustion chamber, the rotating valve sections rotating a one-fourth of the crankshaft speed within a lubricated machined bore, assuring quiet valve operation and minimum wear, the port areas sealed by normally accepted procedures involving use of annular seal rings, further sealing accomplished by carbon accumulation, outer sections locked in place by spring-loaded thrust bearings on shaft ends.

SUMMARY OF THE INVENTION

The stated invention consists of heat resistant valve shaft sections serrated or notched on both ends, one or more sections per cylinder, each section having either intake or exhaust ports or passages or a combination of both drilled or machined diametrically through the shaft diameter, the exhaust passage containing a tube impervious or resistant to extreme temperatures, protruding into but not communicating with the converging-diverging venturi shaped intake passage, as it rotates it aligns or communicates its openings with those of the intake and exhaust manifold and combustion chamber during its cycling sequence. The entire rotating valve shaft consisting of one or more sections per cylinder, each section containing either intake or exhaust ports or passages, or combination of both separated by annular seal rings, rotates at one-fourth the crankshaft speed. The rotating valve sections being serrated or notched on both ends, can be aligned and locked together so as to acheive a specific valve timing sequence according to power requirements of the engine, said sections held in place by spring-loaded thrust bearings positioned on outer ends of completed, locked and aligned or timed rotating valve shaft which is rotating in a lubricated, machined bore or can be rotating in a lubricated bore consisting of two halves haveing access to the intake and exhaust manifold and combustion chamber, the exhaust passage which contains a tube impervious or resistant to extremely high temperatures, protrudes but does not communicate with the converging-diverging venturi shaped intake passage, provides a means to atomize the combustable mixture as it passes through the venturi into the combustion chamber so as to acheive a more complete intake and greater volumetric efficiency of the specific cylinder being charged promoting complete combustion, the intake passage or port within the shaft consisting of a converging-diverging venturi shaped passage so as to accelerate the flow of combustable mixtures, into the combustion chamber, the intake and exhaust passages of the rotating shaft communicating with their respective manifold and combustion chamber ports at the proper time according to the engines valve timing sequence. The main objective of the invention is to provide a valve system completely devoid of reciprocating parts so as to be more effective and less complicated, quiet, and a minimum wear producing method of introducing and eliminating gaseous mixtures consumed and produced by the internal and or external combustion engine.

BRIEF DESCRIPTION OF THE DRAWING

FIG. 2*a*. Shows cross-sectional view of venturi shaped intake port with heated extention designated by the number 7, of the rotary shaft in placement on the engine block.

FIG. 2*b*. Shows cross-sectional view of the exhaust port of the rotary shaft in placement on the engine block.

Figure 1:
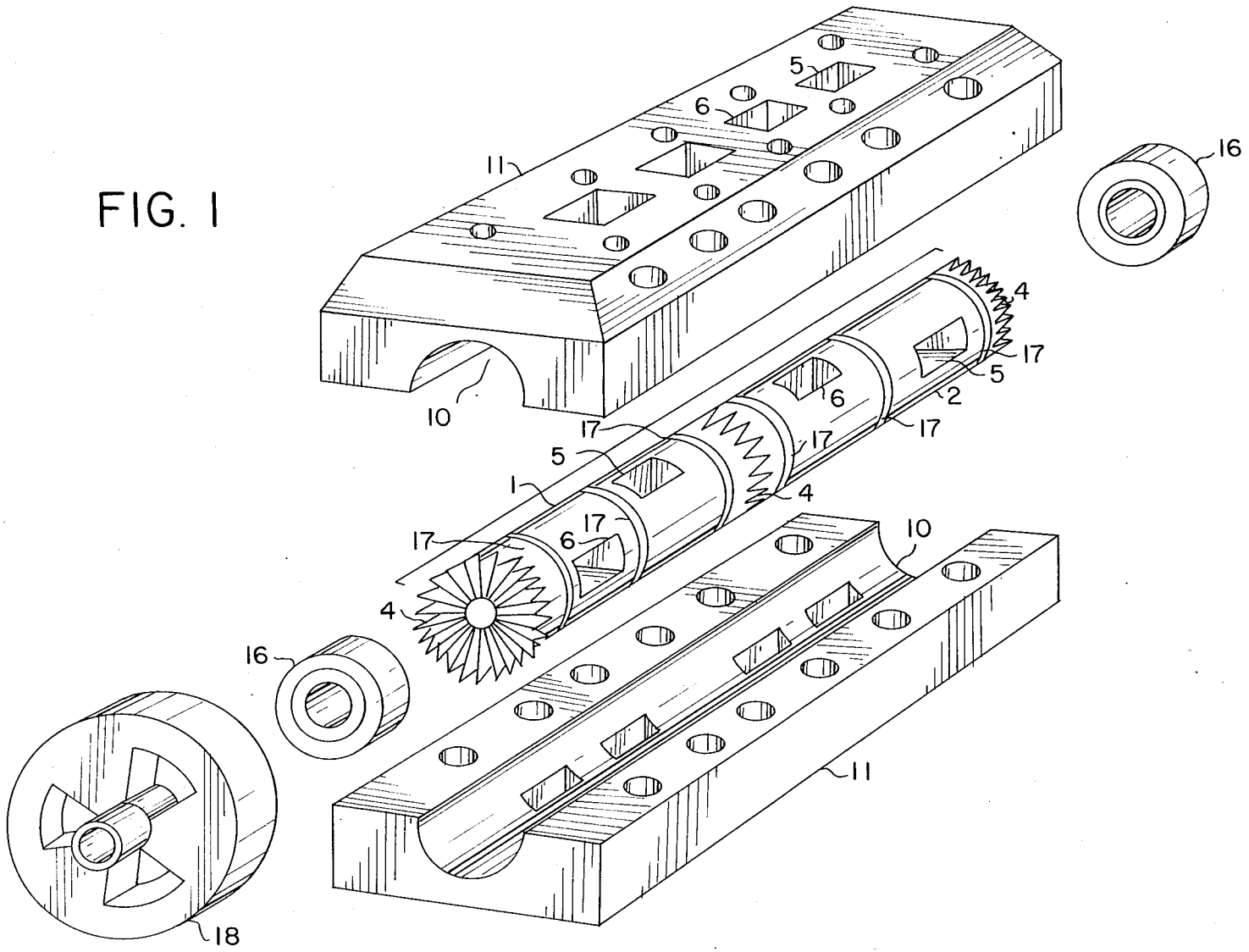
FIG. 1. Shows a dimensional view of the invention, showing exploded views of the following sections, shaft, end thrust bearings intake and exhaust ports, upper and lower bore halves, and pulley.
Figure 2B:
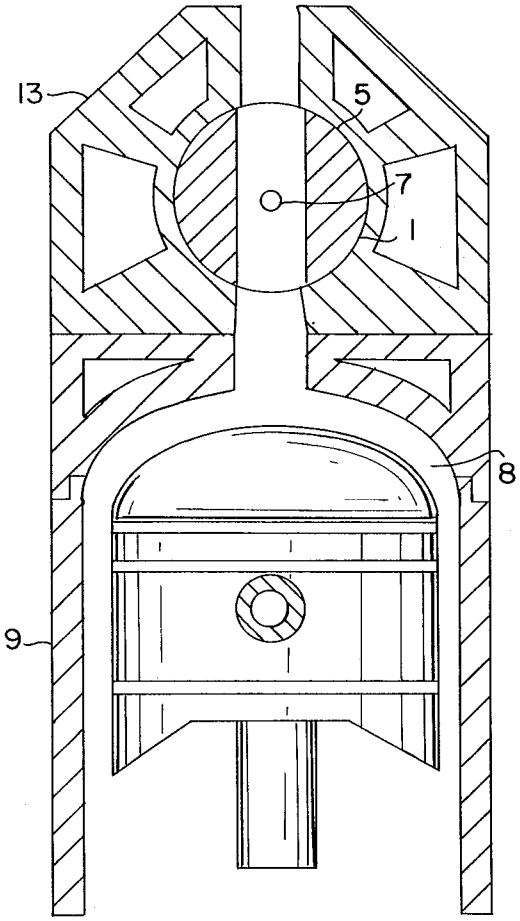
FIGS. 2*a* and 2*b*. Show cross-sectional views of invention in placement on engine, showing block, cylinders, combustion chambers, pistons, rotary valve shaft with intake and exhaust ports.
Figure 2A:
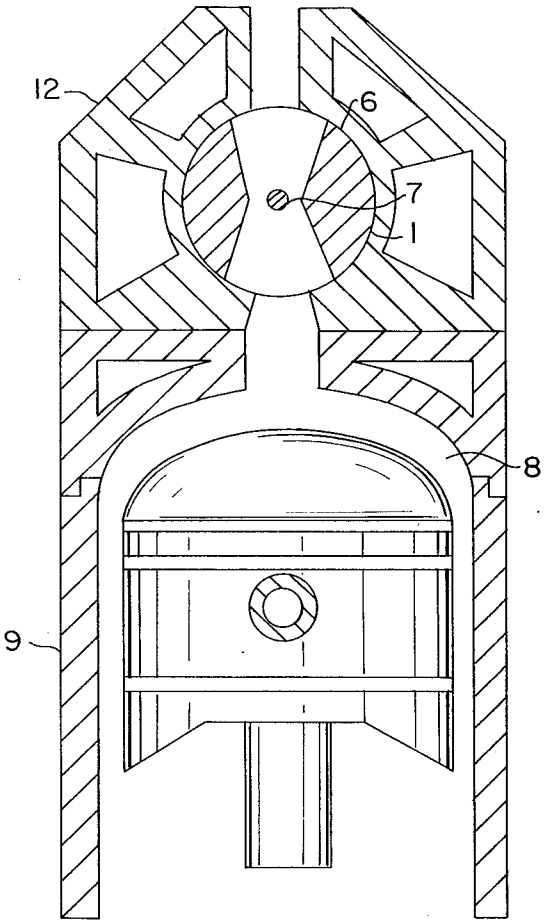
Figure 3C:
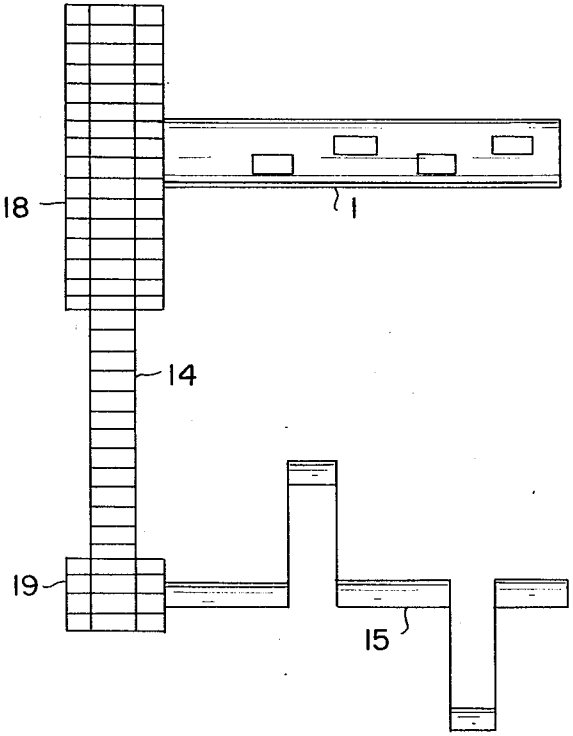
FIG. 3*a*. Shows cross-sectional view of rotary valve segment, showing the venturi shaped intake passage with the heated extention designated by the number 7, and also view of exhaust passage.
Figure 3A:
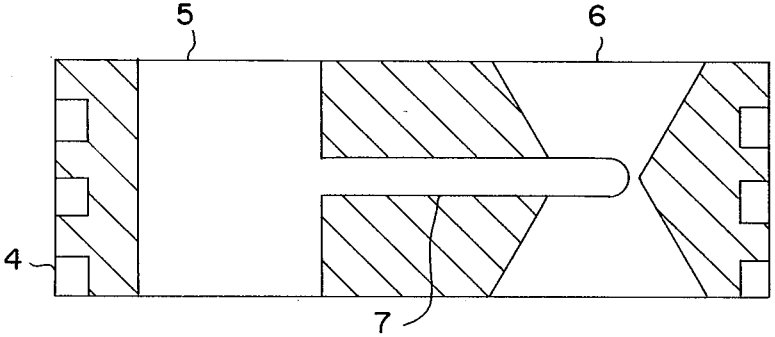
Figure 3B:
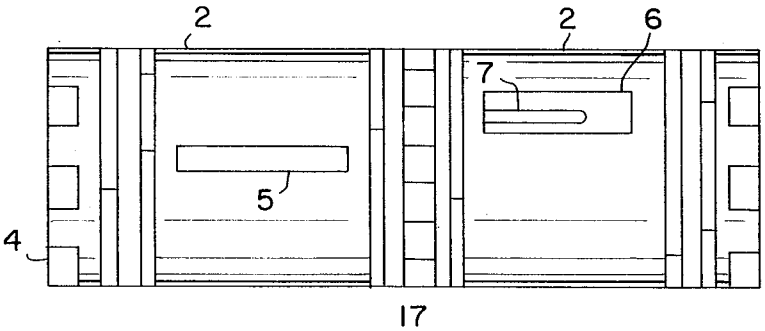

3*b*. Shows view of individually segmented intake valve with heated extention and also the exhaust valve segment with the notched ends inter-locked.

3*c*. Shows horizontal view of rotary shaft with driven member linked to driving member attached to crankshaft.

BREIF DESCRIPTION OF THE PREFERRED EMBODIMENT

In reference to the drawing, the construction of the rotating adjustable valve system 1 have invented, being both simple and basic, is self explaining as to its functions, the complete heat resistant rotating shaft 1, which consists of a series of smaller rotating sections 2, the amounts of sections needed depending on numbers of cylinders 9, in specific engine 3, each section having serrated or notched ends 4, so as to engage or inter-lock with each other, the connecting sections forming a complete adjustable rotating shaft valve assembly or shaft 1, for a given engine 3 each section having passages or ports, the exhaust 5, and intake 6, formed diametrically through the shaft diameter and separated by annular seal rings 17, the exhaust passage 5, having an extention 7 protruding into but not communicating or exposed to the venturi shaped intake passage 6, or path formed within the rotating shaft 1, which contains the valve sections 2, the intake port or passage 6, formed diametrically through the shaft diameter converging to and diverging from the shaft center to form a venturi shaped path so as to speed the flow of combustibly mixtures into and out of the communicating openings of the combustion chamber 8. The intersecting of the heated exhaust passage extention 7, into the intake passage 6, causes the incoming charge of partially atomized combustible mixture to more effectively vaporize into a gaseous state enabling greater volumetric efficiency of the given cylinder being charged. The serrated or notched ends 4, of each of the rotating valve sections 2, allow the altering of valve timing according to specific engine power requirements. The rotating shaft rotates at one-fourth crankshaft speed.

In the functioning of the adjustable rotary valve system, the assembly of heat resistant serrated shaft sections 2, form a complete shaft 1, which rotates in a lubricated machined bore 1O, either one or two-halved 11, said bore having access to the combustion chambers 8, intake 12, and exhaust 13 manifolds, the assembly of adjustable shaft sections 2 held in place by spring-loaded thrust bearings 16, on outer ends of complete shaft assembly 1, being driven by various conventional means such as pulley and belt 14, chain and sprocket, or gears, so as to acheive a ratio of four to one rotation. Driving member 19 on crankshaft 15 is one-fourth the diameter than that of the adjustable rotary valve shaft 1, driven member 18. The ports or openings of the shaft communicate with their respective corresponding ports or openings of the intake 12, and exhaust 13, manifold, and combustion chamber 8, at the proper time, the intake charge as it is being introduced via the venturi shaped passage 6 into the combustion chamber 8, is heated by the exhaust heat as it is intersected by the exhaust extention or protruding tube 7, assuring atomization, the individual rotary shaft sections 2, being serrated 4, can be adjusted to alter valve timing, and can be individually removed to be repaired or replaced with a minimum of time and labor. The ports when communicating with their respective corresponding openings provide instant and complete exposure or access for entry and exit of gases consumed and produced by the engine, which is impossible to acheive with conventional valve systems due to construction and the obstruction of valve heads, stems, physical location, and camshaft lobe and heel designs. In addition, ramp profiles accelerate wear and dictate duration and amounts of combustable mixtures traveling into and out of combustion chambers.

I claim:

1. In an internal combustion engine, including an oil lubrication system, a cooling system, an improved heat resistant intake and exhaust rotary valve shaft system, for the primary purpose of the introduction, and exiting of gaseous mixtures to be consumed in an adjustable timing sequence within the combustion chamber, driven by the rotation of the crankshaft, wherein the improved heat resistant rotary valve system comprises a machined and lubricated bore having access to both the intake and exhaust manifolds and combustion chambers, an adjustable, segmented, serrated rotary valve shaft rotating within said bore which consists of smaller sections having serrated or notched ends containing both intake and exhaust passages, machined diametrically through the rotary shaft sections, intake and exhaust passages within said sections separated and sealed from each other by conventional annular seal rings, or carbon seals, the exhaust passage having a heat resistant tube or extention protruding into but not communicating fluidly with the interior of the intake passage within the individual segmented, serrated, rotary shaft section of the adjustable rotary shaft, for the function of further atomizing the incoming gaseous mixture, the intake passage converging to and diverging from the segmented shaft centers to form a venturi shaped passage, so as to accelerate the gaseous flow, said segmented sections having serrated or notched ends so as to enable the shaft sections to be adjustable so as to produce various specific valve timing requirements, and also to be easily replaceable or repaired, the adjustable rotary valve sections being held in position in the bore by spring loaded thrust bearings, the shaft being driven by the crankshaft at a ratio of four to one.

2. In an internal combustion engine including an oil lubricating system, a cooling system, an improved heat restant intake manifold and exhaust manifold, an intake and exhaust, segmented, serrated, and adjustable rotating valve shaft system for the primary purpose of introduction, and exiting of gases within the combustion chamber, rotating speed of the segmented shaft being one-fourth that of the crankshafts rotation speed, said rotary valve shaft system comprising individual serrated, segmented, adjustable exhaust sections each exhaust section having a tube or extention which protrudes into but does not communicate fluidly with the interior of an adjacent adjustable, serrated segmented, individual intake rotary valve shaft section for atomizing the incoming flow of gases thus promoting more efficient combustion.

3. In an internal combustion engine including an oil lubricating system, a cooling system, an improved heat resistant intake and exhaust segmented, and adjustable rotary valve shaft system for the purpose of introduction and exiting of gases from the combustion chamber, having serrated or notched ends representing various degrees of valve rotation so as to facilitate various degrees of timing requirements according to specific power needs, all change being accomplished by positioning the various segmented, serrated valve sections in position of degrees of rotation desired for specific valve timing sequence, and locking sections in place to form an adjustable segmented, serrated rotary valve shaft assembly.

* * * * *